United States Patent [19]

Scholz et al.

[11] Patent Number: 4,780,649

[45] Date of Patent: Oct. 25, 1988

[54] METAL VAPOR LAMP HAVING LOW STARTING VOLTAGE

[75] Inventors: John A. Scholz, Danvers; Elliot F. Wyner, Peabody, both of Mass.

[73] Assignee: GTE Products Corporation, Danvers, Mass.

[21] Appl. No.: 112,027

[22] Filed: Jul. 27, 1987

Related U.S. Application Data

[63] Continuation of Ser. No. 643,948, Aug. 24, 1984, abandoned.

[51] Int. Cl.[4] ..... H01J 11/04

[52] U.S. Cl. ..... 315/326; 315/227 R; 315/241 P; 315/244; 315/101; 315/330

[58] Field of Search ..... 315/227, 241 P, 241 S, 315/60, 244, 326, 103, 101, 243, 124, 209 R, 330; 361/DIG. 2, 303, 281

[56] References Cited

U.S. PATENT DOCUMENTS

| | | | |
|---|---|---|---|
| 4,037,129 | 7/1977 | Zack et al. | 313/201 |
| 4,071,808 | 1/1978 | Zentmyer | 315/241 P |
| 4,179,640 | 12/1979 | Larson et al. | 315/47 |
| 4,316,122 | 2/1982 | Yamazaki et al. | 315/74 |
| 4,360,762 | 11/1982 | Yamamoto et al. | 315/103 |
| 4,445,073 | 4/1984 | Wyner et al. | 315/56 |
| 4,447,759 | 5/1984 | Moerkens et al. | 315/241 P |
| 4,473,778 | 9/1984 | Adachi | 315/241 P |
| 4,491,766 | 1/1985 | Larson | 315/60 |
| 4,517,496 | 5/1985 | Adachi et al. | 315/241 P |
| 4,647,819 | 3/1987 | Wyner et al. | 315/241 |

OTHER PUBLICATIONS

Investigation on Built In Starter Unit for High Pressure Sodium Lamp, Naoki Saito, 6/81, 53-55-National Technical Report.

*Primary Examiner*—Leo H. Boudreau
*Assistant Examiner*—Michael Razavi
*Attorney, Agent, or Firm*—Joseph S. Romanow; Thomas H. Buffton; José W. Jimenez

[57] ABSTRACT

A high-intensity discharge (HID) metal vapor lamp and starting apparatus includes a metal vapor lamp having an outer envelope containing a gas filled arc tube, the fill gas including xenon, the arc tube having a pair of spaced electrodes with a starting aid surrounding the arc tube intermediate the electrodes, a non-linear dielectric element shunting the spaced electrodes and a ballast means and an electrical conductor coupling the spaced electrodes to a base member connected to a low voltage source whereby starting of the metal vapor lamp from a low voltage source is effected.

20 Claims, 2 Drawing Sheets

METAL VAPOR LAMP HAVING LOW STARTING VOLTAGE

This is a continuation of co-pending application Ser. No. 643,948 filed on Aug. 24, 1984 abandoned.

TECHNICAL FIELD

This invention relates to metal vapor lamps and more particularly to a metal vapor lamp and apparatus for starting a metal vapor lamp from a low voltage source.

BACKGROUND ART

Metal vapor lamps frequently include an elongated alumina or quartz arc tube with an electrode positioned at each end thereof. A metal fill such as mercury, sodium, cadmium, thallium or zinc and usually a rare gas such as Xenon at a pressure in the range of about 14–30 torr is provided within the arc tube. Normally, the metal additive is heated to effect vaporization and provide the radiation species for the lamp. This arc tube is sealed within an outer envelope which is, in turn, formed for connection to a voltage source by way of some form of ballast means. A preferred form of metal vapor lamp is known as a high pressure sodium lamp and includes a mercury and sodium fill therein. Examples of known high pressure sodium lamps are set forth in U.S. Pat. Nos. 4,445,073; 3,900,753 and 4,179,640.

High pressure sodium lamps have become commercially useful within the past few years because of their relatively high efficiency and improved color rendering as compared with the monochromatic yellow light associated with low pressure sodium lamps. These high pressure sodium lamps are distinguishable from the better known low pressure sodium lamps because of the increased operating pressure which may be anywhere from several to about 1000 millimeter Hg.

A major problem associated with high pressure sodium lamps is the difficulty of starting such lamps and more particularly the undesired need for a relatively high potential source in order to effect the desired starting. One means often employed to overcome this undesired need for increased source potentials is the utilization of a so-called "starting aid". Examples of high pressure discharge lamps employing a starting aid include U.S. Pat. Nos. 4,445,073; 3,900,753 and 3,721,846 all assigned to the present Assignee. However, it has been found that there are instances wherein the added starting capability provided by a starting aid is not sufficient to effect the desired starting of the lamp without also undesirably increasing the potential available from a potential source. Obviously, increasing potentials is not always feasible and is certainly undesirable.

Other examples of high pressure sodium lamps utilizing starting aides in an effort to reduce the required starting voltage include U.S. Pat. No. 4,316,122 to Yamazaki et al; an article entitled "Developments In High Pressure Sodium Discharge Lamps" by J. A. J. M. van Vliet and C. A. J. Jacobs distributed at the CIBS National Lighting Conference 1980 and an article entitled "Investigation On Built-In Starter Unit For High Pressure Sodium Lamps" by Naoki Saito and Hiroshi Gion appearing in the National Technical Report Vol. 27 No. 3 June 1981 at the Lighting Division, Matsushita Electronics Corp.

As set forth in the patent of Yamazaki et al (122), the lowest starting voltage obtainable was about 1.3 KV without an electrode extension and a very low 950-volts when an extension was added to the electrode. Also, FIG. 6 of the article of van Vliet and Jacobs indicates a starting voltage in the range of 1.3 to 1.4 KV at a pressure of about 114 torr in an HPS lamp. Moreover, the article of Saito and Gion, FIG. 2 lower curve, indicates a starting voltage of about 1.1 KV when a starting aid is employed in known high pressure sodium lamps. Thus, the above-mentioned patent and published articles suggest that a voltage of not less than about 950 volts is required to effect the desired operation of a high pressure sodium lamp.

Another known technique for improving the starting capability of high pressure sodium lamps is the utilization of a so-called "Penning" gas mixture in conjunction with a starting aid and an increased arc tube diameter. However, it has been found that the improved starting capability provided by the use of the "Penning" gas method is offset by the reduced efficiency and reduced life of the resulting lamps. Examples of such structures includes U.S. Pat. Nos. 3,900,753 of Richardson and 4,037,129 of Zack.

Additionally, it is known to include a supplemental high voltage generating means to a high pressure sodium lamp and accompanying ballast circuitry. Such a configuration is set forth in U.S. Ser. No. 456,679 filed Jan. 10, 1983 entitled HID Lamp Starting Apparatus and assigned to the Assignee of the present application. However, as set forth therein, starting voltages in excess of about 1000 volts were required to effect the desired starting of the discharge lamp.

SUMMARY OF THE INVENTION

An object of the invention is to provide an improved metal vapor lamp. Another object of the invention is to utilize a reduced potential source for starting a metal vapor lamp. A further object of the invention is to provide an improved metal vapor lamp and starting apparatus operable from a low voltage source. A still further object of the invention is to provide a metal vapor lamp connectable to a base member which includes a non-linear dielectric element and choke coil.

These and other objects, advantages and capabilities are achieved in one aspect of the invention by a metal vapor lamp and starting apparatus wherein the metal vapor lamp includes an outer envelope containing a gas-filled arc tube having a pair of spaced electrodes with a starting aid in the form of a wire helix wrapped about the arc tube intermediate the spaced electrodes and connectable to one of the electrodes, a ballast means coupling one electrode and an electrical conductor coupling the other electrode of the arc tube to a base member with a non-linear dielectric element connected to the spaced electrodes shunting the arc tube.

BEST MODE FOR CARRYING OUT THE INVENTION

For a better understanding of the present invention, together with other and further objects advantages and capabilities thereof, reference is made to the following disclosure and appended claims in conjunction with the accompanying drawings.

Figure 1:
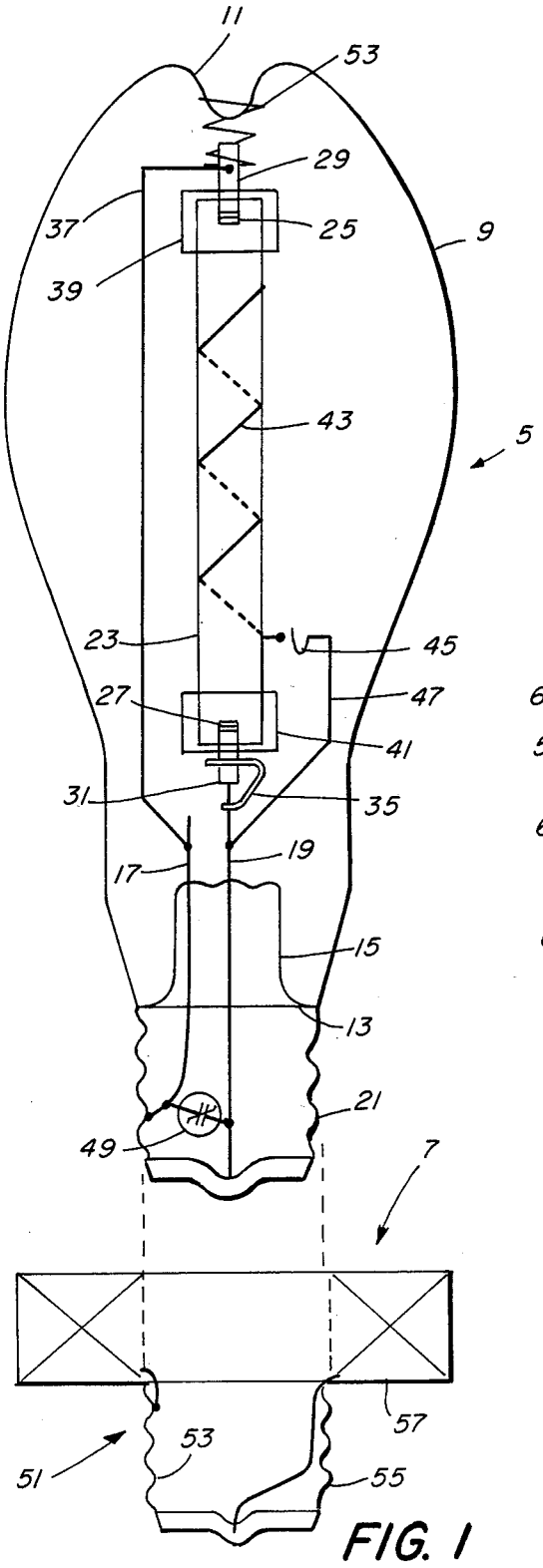
FIG. 1 is an exploded elevational view, partially in section, of a preferred embodiment of the metal vapor lamp and starting apparatus of the invention.

Referring to FIG. 1 of the drawings, a low wattage metal vapor lamp and starting apparatus includes, in this example, a high pressure sodium lamp 5 formed for attachment to a base member 7. The base member 7 is, in turn, configured to fit a socket (not shown) for connection to a low voltage source such as a 110-volt main line source, for example.

The high pressure sodium lamp 5 includes an outer glass envelope 9 having an indentation 11 at one end and a seal 13 with a usual glass stem member 15 at the opposite end. A pair of electrically conductive leads 17 and 19 are sealed into and pass through the stem member 15. Also, a threaded metal member 21 is affixed to the outer glass envelope 9 and electrically connected to the conductive leads 17 and 19.

An alumina arc tube 23 has a pair of spaced electrodes 25 and 27 disposed at opposite ends thereof with each of the electrodes 25 and 27 affixed to niobium tubes 29 and 31 sealed into and passing through the ends of the arc tube 23. A spring-like member 33 encircles the one niobium tube 29 and is telescoped over the indentation 11 of the outer glass envelope 9 to provide support and alignment at one end of the arc tube 23. A support rod 35 is welded to the other niobium tube 31 at the opposite end of the arc tube 23 and to one of the pair of electrically conductive leads 19. Also, a relatively rigid support wire 37 is attached to the other one of the pair of electrically conductive leads 17 and to the niobium tube 29 whereat the spring-like member 33 is attached. Shield members 39 and 41 encircle the ends of the arc tube 23 in the area of the electrodes 25 and 27.

Importantly, a starting aid in the form of a wire helix 43 encircles the arc tube 23 between the spaced electrodes 25 and 27. Preferably, not necessarily, the wire helix 43 is formed to provide electrical connection to and disconnection from a bimetal switch member 45 which is electrically connected to one of the electrodes 27 by way of a conductor 47. Also of importance, a non-linear dielectric element or non-linear capacitor 49 is preferably located within the threaded metal member 21 and is connected to the conductive leads 17 and 19 and shunted across the arc tube 23.

Additionally, a base member 7 includes a socket member 51 having inner and outer metal threads, 53 and 55 respectively, for receiving the threaded metal member 21 and for attachment to an ordinary socket connected to a potential source, (not shown). Also, a ballast means in the form of a substantially circular-shaped choke coil 57 is attached to the socket member 51 and electrically connected thereto and connectable to an electrode 25 of the arc tube 23 by way of the threaded metal member 21, electrically conductive lead 17, support wire 37 and niobium tube 29 when the high pressure sodium lamp 5 is disposed within the base member 7.

Figure 2:
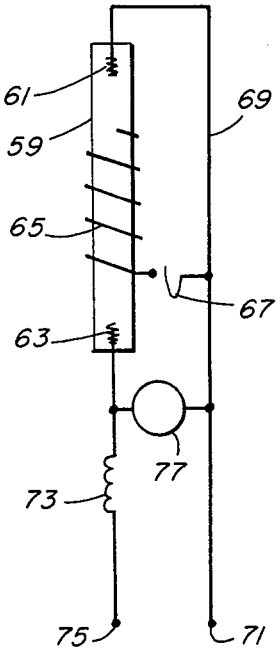
FIG. 2 is a schematic illustration of the metal vapor lamp and starting apparatus of the embodiment of FIG. 1.

Referring to FIG. 2, the high pressure sodium lamp and starting apparatus is schematically illustrated wherein an arc tube 59 has a pair of spaced electrodes 61 and 63. The arc tube 59 is wrapped with a starting aid or wire helix 65 intermediate the spaced electrodes 61 and 63. A bimetal switch 67 is positioned adjacent the starting aid 65. An electrical conductor 69 connects one of the electrodes 61 and the bimetal switch 67 to one side 71 of a low voltage source (not shown). A ballast means or choke coil 73 connects the other electrode 63 to the other side 75 of the low voltage source. Moreover, a non-linear dielectric element 77 is connected to and shunted across the electrodes 61 and 63 of the arc tube 59.

As to operation, it is known that typical high pressure sodium lamps do not lend themselves to incorporation of a starting probe due to the difficulties encountered in sealing electrodes into the arc tube. As a result, it is common and necessary to provide a one to two microsecond pulse in the range of about 2500 to 4000 volts in order to start a high pressure sodium lamp of low wattage, i.e., wattage of about 35, 50 or 70-watts for example. However, to effect such a relatively high starting voltage, 2500 to 4000 volts, it has been the common practice to provide electronic circuitry employing ignitors or magnetic circuitry employing transformers. In the first instance, the electronic circuitry tended to be rather unreliable while, in the second instance, the magnetic circuitry was heavy, awkward and cumbersome and unsuitable for easy inclusion within the available fixtures.

Figure 3:
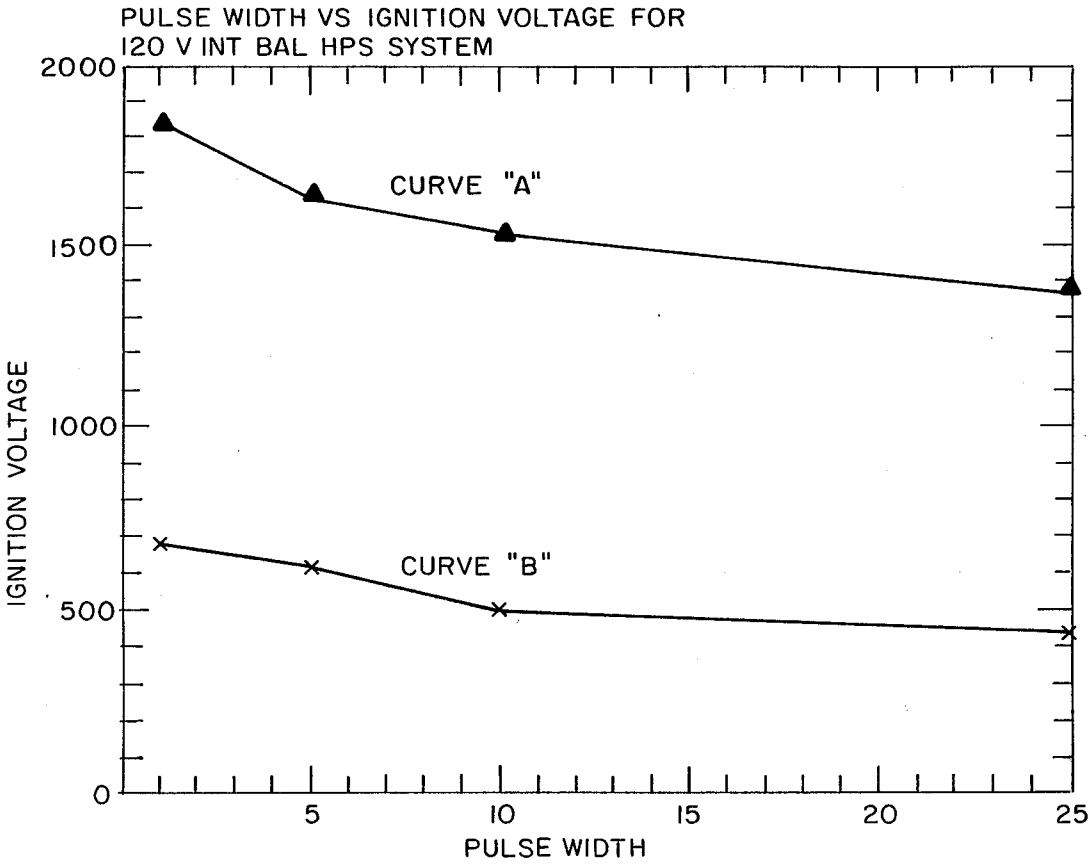
FIG. 3 is a chart comparing ignition voltage of high pressure sodium lamps with and without a starting aid.

However, it has been found possible to manufacture low wattage high pressure sodium lamps and starting apparatus without resorting to electronic or magnetic ballast apparatus for developing 2500 to 4000 volt potentials from a relatively low voltage source. More specifically, a high pressure sodium lamp having an arc tube with a length of about 48 mm, an arc length of about 2.3 mm and an internal diameter of about 4 mm was filled with quantities of mercury, sodium and xenon at a pressure of about 30-torr. This tube was connected to an arc pulse generator which provides the ignition voltage results indicated as curve A of FIG. 3. As can readily be seen, ignition voltage ranges from about 1850-volts to about 1380-volts depending on the pulse width of the supplied potential.

Thereafter, it was found that the addition of a starting aid in the form of about four-turns of tungsten wire centered about the longitudinal mid-point of, circling the arc tube and covering a linear distance of about 20 mm greatly reduced the starting voltage requirements. As can readily be seen in curve B of FIG. 3, the required ignition voltage has dropped from a range of about 1850 to 1380-volts to a greatly reduced value of about 700 to 450-volts depending upon the pulse width in usec.

Additionally, it was also noted that a non-linear dielectric element or a non-linear capacitor such as one designated NLB 1250 manufactured and sold by TDK Corporation of Tokyo, Japan is capable of providing a peak voltage of about 520 peak volts with a half-height pulse width of about 100-usec. Thus, it has been determined that a low wattage high pressure sodium lamp which includes a starting aid and a non-linear dielectric element may be utilized with a simple choke coil to effect starting of the high pressure sodium lamp from a low voltage source such as a 120-volt line source for example.

Further, it has also been found that the life cycle of a high pressure sodium lamp can be significantly extended because of the unique characteristics of the non-linear dielectric element. Also, it is known that the "end of life" of high pressure sodium lamps is characterized by a cycling phenomenon wherein the lamp ignites for a period, goes out, cools down and restrikes again. Also, it is known that the reignition voltage of the lamp exceeds the available ballast voltage. Thus, it has been found that the incorporation of a non-linear dielectric element virtually eliminates this "end of life" phenomenon because the non-linear dielectric element desirably tends to provide a pulse potential at the same time as lamp reignition is to occur. Thus, an added pulse potential is provided when required for lamp reignition and "dropout" and discontinued lamp operation is postponed if not eliminated.

Finally, it has been found advantageous to incorporate a choke coil ballast and base member formed for insertion within a socket connectable to a potential source. Moreover, the high pressure sodium lamp is configured with a threaded metal member formed for insertion within the above-mentioned base member and adopted to include a non-linear dielectric element therein. Thus, the ballast and connections to a voltage source are readily separated from a high pressure sodium lamp which can be separately replaced as a single unit.

While there has been shown and described what is at present considered a preferred embodiment of the invention, it will be obvious to those skilled in the art that various changes and modifications may be made therein without departing from the invention as defined by the appended claims.

We claim:

1. A high-intensity discharge (HID) metal vapor lamp and starting apparatus comprising:

a base member formed for connection to a low voltage source;

a high-intensity discharge metal vapor lamp including a sealed outer envelope containing an arc tube having a pair of spaced electrodes and a starting aid in the form of a wire helix surrounding said arc tube intermediate said pair of spaced electrodes and connectable to one of said pair of spaced electrodes, said arc tube having a fill including xenon, each of said electrodes having not more than one electrical lead-in wire connected thereto;

a ballast means coupling one of said pair of spaced electrodes to said base member;

an electrical conductor coupling the other one of said pair of spaced electrodes to said base member; and a non-linear dielectric element coupled to said pair of spaced electrodes and shunting said arc tube.

2. The metal vapor lamp and starting apparatus of claim 1 wherein said ballast means is in the form of a choke coil.

3. The metal vapor lamp and starting apparatus of claim 1 wherein said arc tube includes a xenon fill gas at a pressure of about 30 torr.

4. The metal vapor lamp and starting apparatus of claim 1 wherein said non-linear dielectric element is disposed within said base member.

5. The metal vapor lamp and starting apparatus of claim 1 wherein said ballast means is in the form of a substantially circular-shaped choke coil affixed to said base member and electrically connectable to one of said pair of spaced electrodes of said metal vapor lamp.

6. The metal vapor lamp and starting apparatus of claim 1 wherein said base member, ballast means and non-linear dielectric element are an integral unit coupled to said metal vapor lamp and to said low voltage source.

7. The metal vapor lamp and starting apparatus of claim 1 including a bi-metal switch for connecting said starting aid to one of said pair of spaced electrodes during non-conductivity of said arc tube.

8. The metal vapor lamp and starting apparatus of claim 1 wherein said starting aid and non-linear dielectric element combine to effect starting of said lamp at a peak output voltage of less than about 900 volts.

9. The metal vapor lamp and starting apparatus of claim 1 including a bi-metal switch, normally-open (N/O) during conduction and normally-closed (N/C) during non-conduction of said metal vapor lamp, said switch positioned adjacent said starting aid and connected to an electrode of said metal vapor lamp.

10. The metal vapor lamp and starting apparatus of claim 1 wherein said arc tube is of a length of about 48 mm with an arc length between electrodes of about 23 mm and said wire helix of said starting aid is of a length of about 20 mm centered about the mid-point of said arc tube.

11. The metal vapor lamp and starting apparatus of claim 1 wherein said non-linear dielectric element is positioned between said arc tube and said base member.

12. The metal vapor lamp and starting apparatus of claim 1 wherein said arc tube includes sodium and mercury fill.

13. The metal vapor lamp and starting apparatus of claim 1 wherein said arc tube includes a fill selected from the metals consisting of mercury, sodium, cadmium, thallium or zinc.

14. A high pressure sodium (HPS) lamp and starting apparatus comprising:

a high pressure sodium (HPS) lamp having an outer sealed envelope containing a xenon-filled arc tube with a pair of spaced electrodes and a starting aid in the form of a wire helix surrounding said arc tube intermediate said pair of spaced electrodes with said starting aid formed for connection to one of said pair of spaced electrodes during non-conduction of said arc tube and for disconnection therefrom during conduction of said arc tube, each of said electrodes having not more than one electrical lead-in wire connected thereto;

a ballast means connected to one of said pair of spaced electrodes;

a non-linear dielectric element connected to said pair of spaced electrodes and shunting said arc tube; and a base member formed for connection to a low voltage source, to said ballast means and to said other one of said pair of spaced electrodes.

15. The high pressure sodium (HPS) lamp and starting apparatus of claim 14 wherein said base member, non-linear dielectric element and ballast means are an integral unit formed for coupling said high pressure sodium lamp to a low voltage source.

16. The high pressure sodium (HPS) lamp and starting apparatus of claim 14 wherein said ballast means is in the form of a choke coil of substantially circular configuration and connected to said base member.

17. The high pressure sodium (HPS) lamp and starting apparatus of claim 14 wherein said non-linear dielectric element is disposed within said base member and said ballast means is affixed to said base member and electrically connected thereto and to said high pressure sodium (HPS) lamp.

18. The high pressure sodium (HPS) lamp and starting apparatus of claim 14 wherein said high pressure sodium (HPS) lamp includes a bi-metal switch for effecting said disconnection of said starting aid from one of said pair of spaced electrodes during conduction of said arc tube.

19. The high pressure sodium (HPS) lamp and starting apparatus of claim 14 wherein said starting aid and said non-linear dielectric element combine to effect starting of said lamp at a peak output voltage from said non-linear dielectric element of less than about 900 volts.

20. The high pressure sodium (HPS) lamp and starting apparatus of claim 14 wherein said high pressure sodium lamp is of a wattage in the range of about 35 to 70 watts.

* * * * *